US010442655B2

(12) United States Patent
Meachum et al.

(10) Patent No.: US 10,442,655 B2
(45) Date of Patent: Oct. 15, 2019

(54) INERTIA BRAKING PAYOUT DEVICE AND PACKAGE SYSTEM

(71) Applicant: Honeywell International Inc., Morristown, NJ (US)

(72) Inventors: Brian Meachum, Pleasant Prairie, WI (US); Daniel D. Dunar, Mequon, WI (US)

(73) Assignee: ADEMCO INC., Golden Valley, MN (US)

( * ) Notice: Subject to any disclaimer, the term of this patent is extended or adjusted under 35 U.S.C. 154(b) by 272 days.

(21) Appl. No.: 15/269,750

(22) Filed: Sep. 19, 2016

(65) Prior Publication Data

US 2017/0008726 A1 Jan. 12, 2017

Related U.S. Application Data

(63) Continuation of application No. 14/322,477, filed on Jul. 2, 2014, now Pat. No. 9,446,928.
(Continued)

(51) Int. Cl.
*B65H 49/00* (2006.01)
*B65H 49/20* (2006.01)
*B65H 49/32* (2006.01)

(52) U.S. Cl.
CPC ..... *B65H 49/205* (2013.01); *B65H 49/322* (2013.01); *B65H 2301/5154* (2013.01);
(Continued)

(58) Field of Classification Search
CPC ..... B65H 49/205; B65H 49/322; B65H 2301/5154; B65H 2701/50
See application file for complete search history.

(56) References Cited

U.S. PATENT DOCUMENTS 4,010,914 A * 3/1977 Kowalski ..... B65H 49/322 242/129.62
4,168,778 A 9/1979 Buxton
(Continued)

FOREIGN PATENT DOCUMENTS

CN 1333177 A 1/2002
WO WO 2013/041771 A1 3/2013

OTHER PUBLICATIONS

Extended European Search Report, dated Jun. 22, 2015, corresponding to EP Application No. EP 15 15 0979.
(Continued)

*Primary Examiner* — Sang K Kim
(74) *Attorney, Agent, or Firm* — Husch Blackwell LLP

(57) ABSTRACT

A payout device that includes a carton, a rotatable member, and a slot is provided. The carton can include an opening that provides an egress for elongated flexible material stored within the carton. The rotatable member can be disposed within the carton, the rotatable member can have a circumference, and the elongated flexible material can be wound around the rotatable member. The slot can rotatably support the rotatable member, the slot can have a round shape that is larger than the circumference of the rotatable member, at least a portion of the rotatable member can be slidable within the slot between a payoff position and a braking position, the rotatable member can be rotatable within the slot when in the payoff position for dispensing the elongated flexible material from the opening in the carton, and the payoff position can be elevated relative to the braking position.

16 Claims, 6 Drawing Sheets

Related U.S. Application Data

(60) Provisional application No. 61/928,545, filed on Jan. 17, 2014.

(52) U.S. Cl.
CPC ..... *B65H 2701/33* (2013.01); *B65H 2701/35* (2013.01); *B65H 2701/36* (2013.01); *B65H 2701/37* (2013.01); *B65H 2701/3911* (2013.01); *B65H 2701/50* (2013.01)

(56) References Cited

U.S. PATENT DOCUMENTS

| | | | |
|---|---|---|---|
| 5,967,451 | A | 10/1999 | Radaios |
| 2010/0314483 | A1 | 12/2010 | Shah et al. |
| 2011/0147249 | A1 | 6/2011 | Huffman et al. |

OTHER PUBLICATIONS

First Office Acton and Search Report from corresponding CN patent application 201510021816.7, dated Jun. 2, 2017.
English-language translation of Abstract for CN patent application 1333177, dated Jan. 30, 2002.

* cited by examiner

INERTIA BRAKING PAYOUT DEVICE AND PACKAGE SYSTEM

CROSS REFERENCE TO RELATED APPLICATION

This application is a continuation of and claims the benefit of the filing date of U.S. patent application Ser. No. 14/322,477 filed Jul. 2, 2014, which claims the benefit of the filing date of U.S. Provisional Patent Application Ser. No. 61/928,545 filed Jan. 17, 2014, the entirety of which are hereby incorporated by reference as if fully set forth herein.

FIELD

The subject invention pertains generally to a device for packaging and dispensing elongated flexible spoolable material and, more particularly, to a dispensing device housing a rotatable member supported by tapered slots which prevent unintended rotation of the rotatable member and/or inadvertent payout of the material.

BACKGROUND

Traditional payout packaging devices for elongated flexible material such as, for example, cable, wire, rope, chain, strapping or the like, typically employ a rotatable spool suspended by "stanchions" (stands) on either side of the reel. In dispensing material from such a device, typically a user will pull a free end of the material causing the spool to rotate and the material to unwind therefrom. Once a desired portion of the material has been unwound from the spool, the user can cut off an amount that is needed, leaving the remainder of the material on the spool for future use.

As a disposable design, such traditional devices are typically passive and allow for "free wheel" or "over spin" of the spool/reel during use. Such over spin can cause tangling or excess payout of the material being dispensed which can lead to added scrap or waste and/or additional labor to wind back the device or process the unused material. Over time, such issues and efforts can increase frustration, production time and costs for a user.

Known designs attempt to address this issue by incorporating a passive friction brake that can generate additional tension to reduce the spin of the reel. However, such alternate designs can create an over tension problem for installers/users. Such devices are additionally unreliable and/or impractical to the extent that the braking mechanism is either fabricated from low-grade material that can frequently be damaged or break, or is alternatively constructed from more well-made materials that are costly to produce. Accordingly, an economical solution is needed which can prevent over spin while limiting engagement when tension is applied.

Thus, in view of the foregoing, it would be extremely useful to have the benefit of a payout device as disclosed herein that can provide minimal reactive tension on the dispensed material while it is being pulled and additionally engage a braking function when no tension is applied to the material being dispensed. It would further be desirable if such a device was economical, light weight and reusable so that it can be procured without excessive investment and further be assembled, operated, transported and reloaded without undue labor or attention. It will be recognized by persons of ordinary skill in the art that such a device can improve the operation and productivity of a user's operation and/or business.

DETAILED DESCRIPTION

Figure 1:
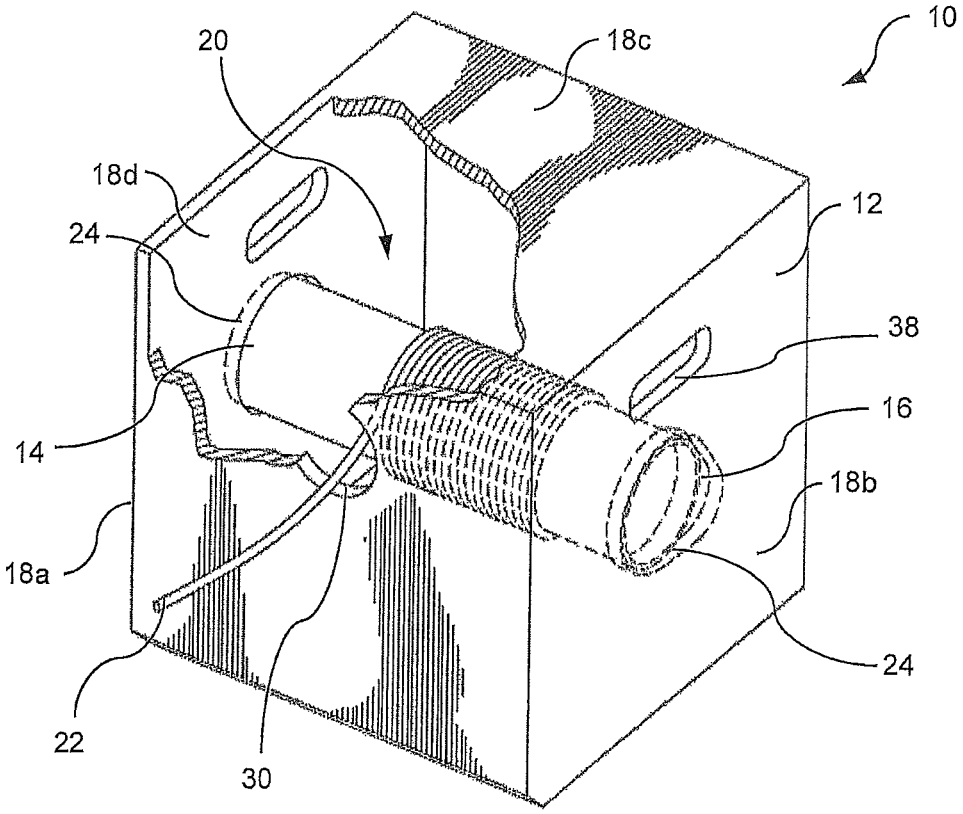
FIG. 1 is a first perspective view of a device in accordance with embodiments presented herewith with the exterior panels partially cut-away to illustrate the interior elements of said device.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

As presented herein, embodiments of the subject invention are directed to a device for packaging and payout of elongated flexible material. The device can feature a rotatable member, a carton, container or housing enclosing the rotatable member and at least one support member having a slot for rotatably supporting the rotatable member within the carton. According to such embodiments, the rotatable member can include, for example, a reel, spool, mandrel, rod, shaft, roll or similar article that rotates around a fixed central longitudinal axis and can carry elongated flexible material around its outer circumference. The rotatable member can have an elongated configuration and be positioned partially or entirely within an interior compartment of the carton. Elongated flexible material can be wound around the rotatable member and extend through an opening in the carton so as to enable an individual to pull a free end of the material in order to dispense a desired amount of material from the carton. When the free end of the material is pulled, the rotatable member can rotate and material wound around the rotatable member can unwind therefrom and be pulled from the carton. When a desired amount of the material has been withdrawn from the carton, a user can cut or trim a section of the material, thus exposing a new free end for the remaining material still wound around the rotatable member. When material is not under tension (i.e., being pulled from the carton), the device is configured to provide resistance to the rotatable member to prevent unintended or excessive rotation and/or inadvertent payout of the material wound thereon.

As described herein, it will be understood by persons of ordinary skill in the art that embodiments of the subject invention can be used, without limitation, in connection with any kind of elongated flexible material that can be wound or spooled without departing from the novel scope of the subject invention. Such material can include, for example, wire, cable, rope, chain, strapping, banding, string, line, cord, tape, hose, plastic film, ribbon, cloth or any kind of analogous flexible or spoolable material.

With reference now to the figures, FIG. 1 illustrates an exemplary device 10 as presented herein. The device 10 can include a carton or container 12, a rotatable member or elongated rotatable member 14 such as a reel or spool, and a support structure 16 featuring one or more slots 24 for rotatably supporting at least a portion of the reel 14 within the carton 12. The carton 12 can be comprised of a plurality of panels 18*a-d* joined together at their respective end edges and corners. The panels 18*a-d* can form an interior chamber, cavity or compartment 20 for storing the elongated flexible payout material 22, at least a portion of which can be wound around the exterior surface of the rotatable member 14. At least one of the panels 18*a*-18*d* can additionally include an opening 30 providing an egress for the material 22 to exit the container 12. The carton 12 can be made from any type of lightweight, durable and/or recyclable material, such as for example, cardboard, reinforced corrugated fiberboard, plastic, wood, fiberglass or plastic.

Although the embodiment illustrated in FIG. 1 shows the device 10 as having a rectangular/cubical-shaped carton 12 formed by six flat panels 18*a*-18*d* having the same size/shape, persons of ordinary skill in the art will understand that the device 10 can have alternate shapes, sizes or configurations as desired. For example, the carton 12 can feature more or less panels 18*a-d* as need be, can have curved panels, such as for example, where the carton 12 is cylindrical in shape, or can have panels 18*a-d* of different sizes. The carton 12 can additionally be customized to accommodate various sizes of reels 14 or different amounts of payout material 22, or can be produced or made available in standard uniform sizes or shapes to assist in warehousing or transportation.

According to embodiments presented herein, the support structure 16 can include one or more slots 24 which can be sized and shaped for receiving a portion of the rotatable member 14. The support structure 16 can be incorporated into the panels 18*a-d*, or can be a separate structure(s) located within the interior compartment 20 of the carton 12 or outside the panels 18*a-d*. FIG. 1 illustrates the support structure 16 as including slots 24 integrated into opposing panels 18*b*, 18*d* for receiving the ends of the rotatable member 14. Thus, in this instance, the slots 16 are spaced apart from one another and rotatably support the rotatable reel or spool 14 at opposing ends, with the length of the rotatable member 14 spanning the interior compartment 20 of the carton 12. The slots 16 can extend completely through the panels 18*b*, 18*d* to allow the ends of the rotatable member 14 to extend outside the carton 12, or merely be channels or grooves formed on the interior sides of the panels 18*b*, 18*d*.

Embodiments presented herein can have alternate or additional support structures 16 or configurations as desired. For example, the support structure 16 can include plates (not pictured) secured to the interior or exterior of panels 18*a*-18*d* or a u-shaped bracket (not pictured) having a transverse portion joining opposing arms that extend substantially parallel to opposing panels 18*a-d* of the carton 12. In such instances, the plates or arms of the support structure 16 can include at least one slot 24 of the type illustrated in FIG. 1 which can receive a portion of the rotatable member 14 for rotatably supporting the member 14 at some point along its length. Although FIG. 1 illustrates slots 24 supporting the rotatable member 14 at the opposing ends, it will be recognized that such slots 24 can support the member 14 at any point along its length.

Figure 2A:
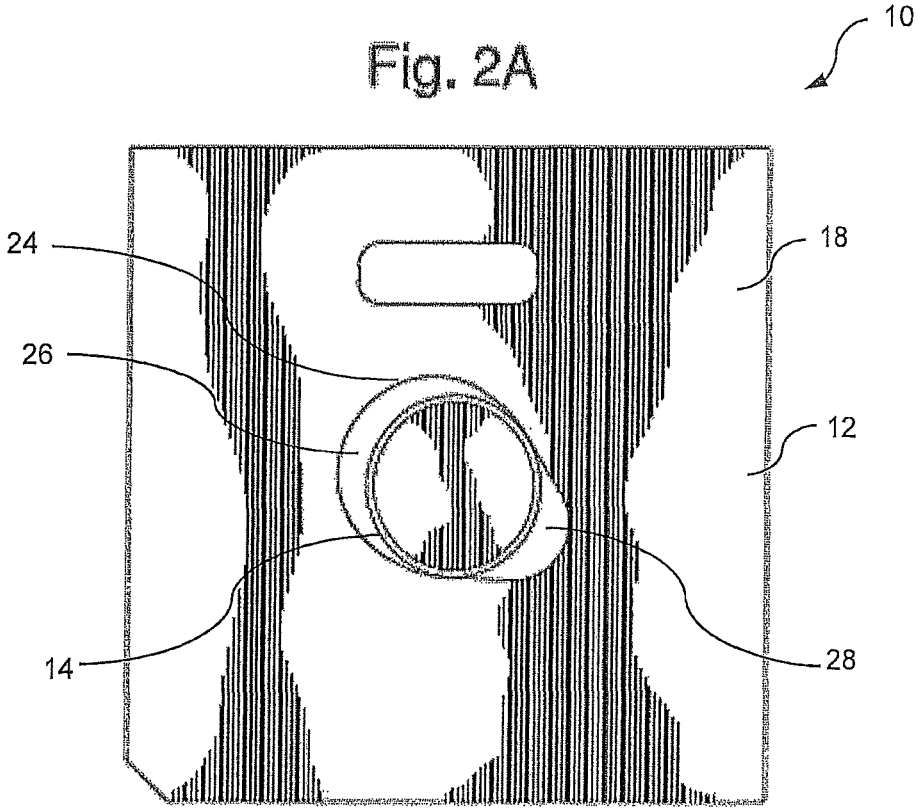
FIG. 2A is a first elevation view of an interior side of a representative device with the rotatable member in the braking position.
Figure 2B:
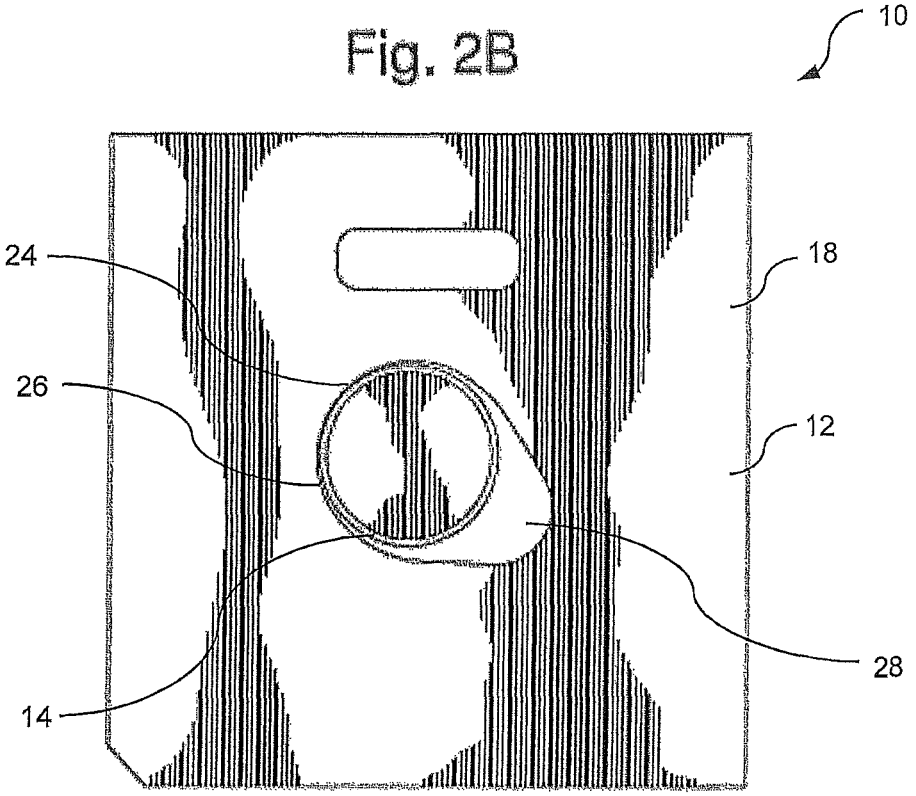
FIG. 2B is a second elevation view of an interior side of a representative device with the rotatable member in the payout position.

FIGS. 1 and 2A-2B illustrate additional detail with regard to the slot(s) 24 according to embodiments presented herein. The slot 24 can have a tapered teardrop-shaped configuration having a wide larger diameter end 26 and a narrow smaller diameter end 28. The slot 24 can be sized and shaped to receive at least a portion of the rotatable member 14 so that it can slide between the larger diameter end 26 and the smaller diameter end 28. The larger diameter end 26 can be sized to accommodate the full diameter of the rotatable member 14 such that the member 14 is able to rotate with minimal friction or resistance from the edge of the slot 24 when the rotatable member 14 is in the larger diameter end 26. The smaller diameter end 28 of the slot 24 can be sized to have a diameter equal to or less than the diameter of the rotatable member 14, such that the smaller diameter end 28 either cannot receive the full diameter of the rotatable member 14 or provides a snug fit around the outer circumference of the member 14.

According to embodiments presented herein, the slot(s) 24 (and/or the support structure 16 for the slots 24) can be positioned on or in the carton 12 in an upright and forwardly angled position relative to a vertical axis, whereby the larger diameter end 26 is elevated from the smaller diameter end 28 and is further positioned slightly closer to the opening 30. FIG. 1 illustrates an exemplary position of the slot 24 relative to the opening 30. In this arrangement, the rotatable member 14 extends substantially parallel to the horizontal surface such that the device can rely on gravity to provide a breaking mechanism. In particular, when tension is applied to the elongated material 22, such as when a user pulls the material for payout, the rotatable member 14 can slide into the larger diameter end 26 of the slots 24. Conversely, when tension on the material 22 is absent or withdrawn, the rotatable member 14 will slide back towards the smaller diameter end 28 of the slot 24.

FIGS. 2A and 2B further illustrate the rotatable member 14 in varying positions within the slot 24. In FIG. 2A, the rotatable member 14 is shown in a position representative of a "breaking" or "idle" position which is typical when no tension is being applied to the payout material 22 wound around the rotatable member 14. In such circumstances, the member 14 can rest in a position towards the smaller diameter end 28 such that the outer circumference of the rotatable member 14 is in contact with portions of the edge of the slot 24. In this position, the edge of the slot 24 can provide resistance, friction or otherwise "pinch" the outer surface of the rotatable member 14 which can produce a breaking function preventing the rotatable member 14 from rotating. Such braking function can prevent unintended payout of the material 22 and can additionally cause the material 22 to slightly retract into the carton 12 to minimize the amount of extraneous material withdrawn from the carton 12.

FIG. 2B illustrates the rotatable member 14 in a position representative of a "payout" position which can be typical when tension is being applied to the payout material 22 wound around the rotatable member 14. In such circumstances, the rotatable member 14 can slide into a position towards the larger diameter end 26 of the slot 24 such that the edge of the slot 24 provides minimal contact or resistance to the outer circumference of the rotatable member 14. In this position, the member 14 can be allowed to rotate freely or with minimal resistance so that a user is able to easily withdraw as much material 22 as may be needed. When the user decides that a sufficient amount of material has been withdrawn and ceases pulling the material 22, the rotatable member 14 can slide within the slot towards the small diameter end 28 to return to the "braking" position as illustrated in FIG. 2A. Thus, with the assistance of gravity, embodiments of the subject invention can provide an automatic braking function which does not require a user to manually engage any braking device to stop the rotatable member 14 from further rotating.

It will be recognized that the subject device 12 can allow for little reactive tension on the payout material 22 while it is being pulled and additionally engage a braking function when no tension is applied to the material 22. It will be further recognized that additional benefits of the subject device are that it can be customer/user friendly in that it is relatively easy to use and requires little labor to operate or to load a new rotatable member 14 or payout material 22. In addition, the automated braking function can prevent excessive discharge of the payout material 22 which can typically result in wasted material and/or tangles or kinking of the material 22 which can require additional user attention and/or delay. Further benefits of the device disclosed herein are that it can be economical, easy to transport and be environmental-friendly.

Figure 3:
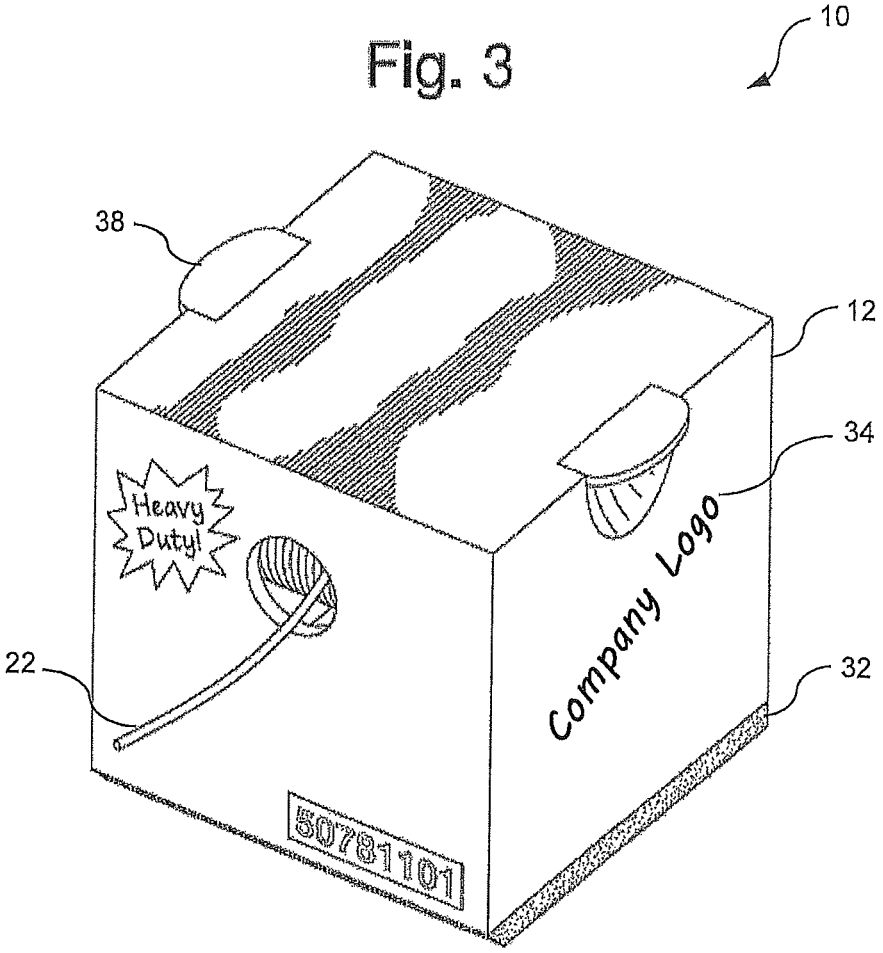
FIG. 3 is a second perspective view illustrating an assembled device according to embodiments disclosed herein.

FIG. 3 illustrates additional features and benefits of the subject invention. In particular, the device 10 can include a weighted or texturized base 32, including, for example, a weighted plate or a tactile or texturized pad. Such features can provide the device 10 with greater grip strength and/or a lower center of gravity in order to keep the device from unintentionally sliding, tipping or being overturned during use. The exterior of the carton 12 can also include customized design elements 34, such as, for example, bright colors or distinctive markings, lettering, graphics or logos to make it stand out, for commercial or advertising purposes or to conceal dirt or dust.

Figure 4A:
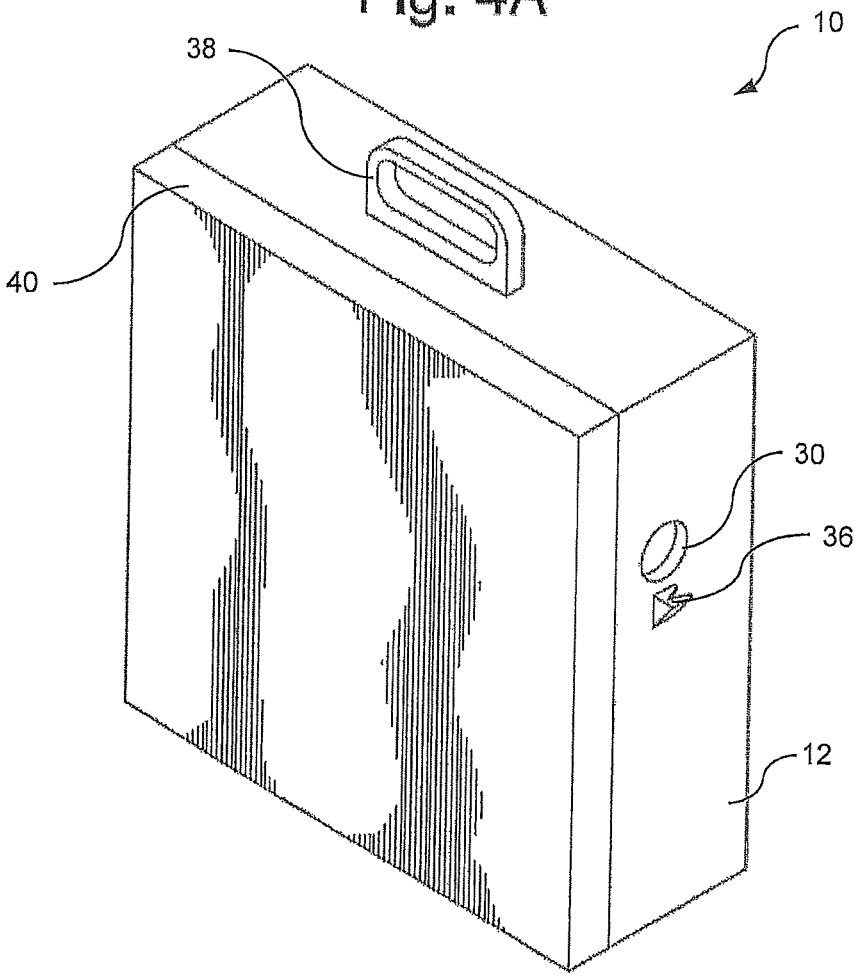
FIG. 4A is a third perspective view illustrating an assembled device with a side panel in a closed position.
Figure 4B:
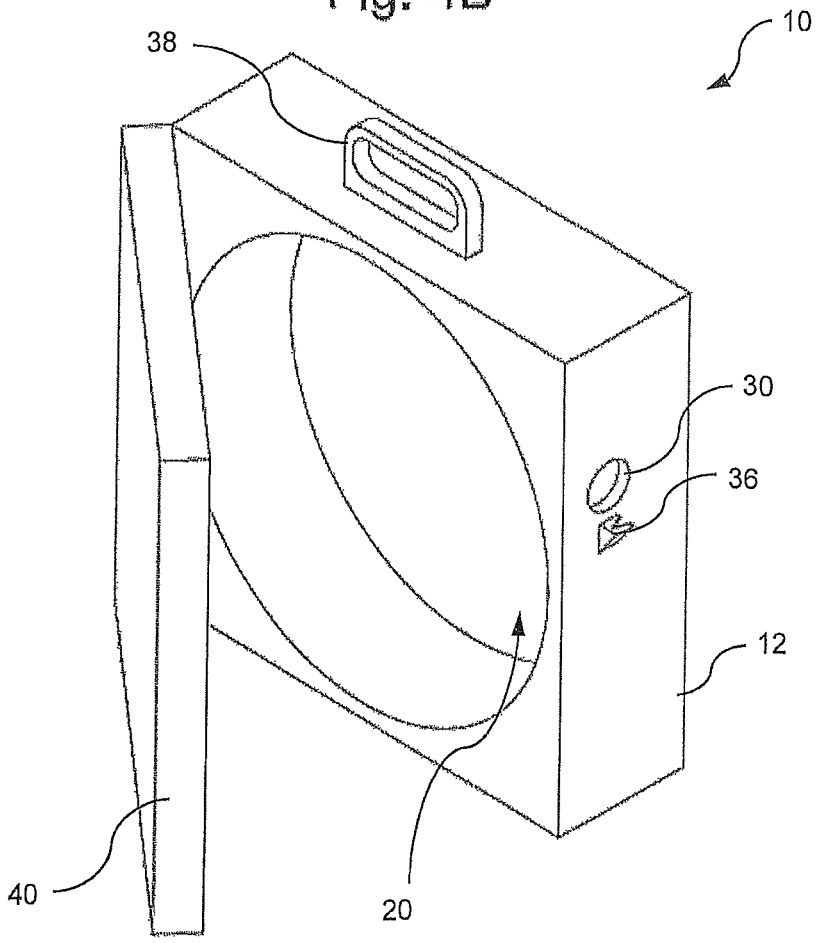
FIG. 4B is a fourth perspective view illustrating an assembled device with a side panel in an open position.

FIGS. 4A and 4B illustrate additional features according to embodiments presented herein. For example, the device can include a built-in cutting device 36 proximate the opening to enable a user to cut the desired amount of payout material once it has been withdrawn from the carton 12. The device 10 can additionally feature a handle 38 to assist with transporting the device. As shown in FIGS. 4A and 4B, the handle 38 can extend away from a panel 18*a* of the carton, or be incorporated into a panel 18*a-d* as shown in FIG. 1.

The device 10 can additionally include an access door 40 on at least one panel 18*a-d* for accessing the interior compartment 20. The access door can be hinged, slidable or removable from the carton 12 as need be and can be an entire panel 18*a-d* or merely disposed on a portion of a panel. FIG. 4A illustrates a device 10 with an access door 40 in a closed position enclosing the interior compartment 20. FIG. 4B illustrates a device 10 with a hinged access door 40 in an open position revealing the interior compartment 22. The door 40 can assist with changing or replacing the rotatable member 14 or the payout material 22. As shown in FIG. 4B, the interior compartment 20 of the device 10 can have a cylindrical or annular shape to conform with the shape of the rotatable member 14 and payout material 22 supported thereon. The cylindrically-shaped compartment 20 can facilitate smooth rotation of the payout material 22 around the interior compartment 20 when the member 14 is being rotated to prevent the material 22 from being snagged, caught or being accumulated in a corner of the compartment 22.

Persons of ordinary skill in the art will further understand that the carton 12 can be reusable such that once a spool, reel or mandrel 14 of payout material 22 is exhausted, another can be easily loaded into the carton 12 or the material 22 can be reloaded on the existing member 14. Additionally, the device 10 can be provided as a fully assembled unit or partially assembled as need be. For example, the carton 12 can include slots, flaps or folds enabling the carton 12 to be easily collapsible for assembly and disassembly before or after use. Further, whether fully or partially assembled, one or more cartons 12 can be transported on a shipping pallet with the spool 14 and payout material 22 pre-loaded in place and ready for use, or such internal components can be provided within an assembled carton in an unassembled state. Alternatively, the carton 12 can be transported or provided in a collapsed unassembled state with the rotatable reel 14, support members 16 and payout material 22 accompanying the materials, or provided separately altogether.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown, or sequential order, to achieve desirable results. Other steps may be provided, or steps may be eliminated, from the described flows, and other components may be added to, or removed from the described embodiments.

What is claimed is:

1. A payout device comprising:

a carton, wherein the carton includes an opening that provides an egress for elongated flexible material stored within the carton;

a rotatable member disposed within the carton, wherein the rotatable member has a circumference, and wherein the elongated flexible material is wound around the rotatable member; and a slot that rotatably supports the rotatable member, wherein the slot has a round shape comprising a payoff position that is larger than the circumference of the rotatable member and a braking position that is smaller than the circumference of the rotatable member, wherein at least a portion of the rotatable member is slidable within the slot between the payoff position and the braking position, wherein the rotatable member is rotatable within the slot when in the payoff position for dispensing the elongated flexible material from the opening in the carton, and wherein the payoff position is elevated relative to the braking position.

2. The device of claim 1 wherein the payoff position is closer to the opening than the braking position.

3. The device of claim 1 wherein tension applied to the elongated flexible material moves the rotatable member from the braking position to the payoff position.

4. The device of claim 3 wherein one or more of gravity and a weight of the rotatable member holds the rotatable member in the braking position when the tension is released from the elongated flexible material.

5. The device of claim 1 wherein the round shape of the slot is teardrop-shaped.

6. The device of claim 1 wherein the round shape of the slot is elongated.

7. The device of claim 1 wherein at least a portion of the carton is made of a reinforced material.

8. The device of claim 1 wherein the carton is made of cardboard.

9. A payout device comprising:

a carton, wherein the carton includes an opening that provides an egress for elongated flexible material stored within the carton;

an elongated rotatable cylindrical member disposed within the carton, wherein the elongated rotatable cylindrical member has a circumference around which the elongated flexible material is wound; and two slots for rotatably supporting the elongated rotatable cylindrical member at opposing ends thereof, wherein each of the two slots has a round shape comprising a payoff position that is larger than the circumference of the elongated rotatable cylindrical member and a braking position that is smaller than the circumference of the elongated rotatable cylindrical member, wherein at least a portion of the elongated rotatable cylindrical member is slidable within each of the two slots between the payoff position and the braking position, wherein the elongated rotatable cylindrical member is rotatable within each of the two slots when in the payoff position for dispensing the elongated flexible material from the opening in the carton, and wherein the payoff position is elevated relative to the braking position.

10. The device of claim 9 wherein the payoff position is closer to the opening than the braking position.

11. The device of claim 9 wherein tension applied to the elongated flexible material moves the elongated rotatable cylindrical member from the braking position to the payoff position.

12. The device of claim 11 wherein one or more of gravity and a weight of the elongated rotatable cylindrical member holds the elongated rotatable cylindrical member in the braking position when the tension is released from the elongated flexible material.

13. The device of claim 9 wherein the round shape of each of the two slots is teardrop-shaped.

14. The device of claim 9 wherein the round shape of each of the two slots is elongated.

15. The device of claim 9 wherein at least a portion of the carton is made of a reinforced material.

16. The device of claim 9 wherein the carton is made of cardboard.

* * * * *